US011110710B2

(12) United States Patent
Nunokawa

(10) Patent No.: US 11,110,710 B2
(45) Date of Patent: Sep. 7, 2021

(54) LIQUID EJECTING DEVICE

(71) Applicant: SEIKO EPSON CORPORATION, Tokyo (JP)

(72) Inventor: Yohei Nunokawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/798,868

(22) Filed: Feb. 24, 2020

(65) Prior Publication Data

US 2020/0269584 A1 Aug. 27, 2020

(30) Foreign Application Priority Data

Feb. 25, 2019 (JP) ..... JP2019-031336

(51) Int. Cl.
*B41J 29/17* (2006.01)
*B41J 2/165* (2006.01)
*B41J 11/00* (2006.01)

(52) U.S. Cl.
CPC ..... *B41J 2/16579* (2013.01); *B41J 2/16505* (2013.01); *B41J 11/0095* (2013.01); *B41J 29/17* (2013.01)

(58) Field of Classification Search
CPC ..... B41J 29/17; B41J 11/0095
See application file for complete search history.

(56) References Cited

U.S. PATENT DOCUMENTS

2013/0141487 A1* 6/2013 Abe ..... B41J 11/0095 347/16

FOREIGN PATENT DOCUMENTS

JP 2004-284278 10/2004
JP 2018104163 A * 7/2018

* cited by examiner

*Primary Examiner* — Sharon Polk
(74) *Attorney, Agent, or Firm* — Workman Nydegger

(57) ABSTRACT

Provided is a liquid ejecting device including an ejecting unit configured to eject a liquid onto a medium, a detector configured to emit light toward an object opposing the ejecting unit and receive reflected light generated by reflection of the light thereby detecting information, and a cover portion including a cover that transmits the light and is disposed at a position to cover the detector. The cover portion is configured to move the cover so as to change a portion of the cover that covers the detector while the detector remains covered.

8 Claims, 12 Drawing Sheets

LIQUID EJECTING DEVICE

The present application is based on, and claims priority from JP Application Serial Number 2019-031336, filed Feb. 25, 2019, the disclosure of which is hereby incorporated by reference herein in its entirety.

BACKGROUND

1. Technical Field

The present disclosure relates to a liquid ejecting device.

2. Related Art

Liquid ejecting devices of various configurations have been used. One such liquid ejecting device is a liquid ejecting device including an ejecting unit and a detector configured to emit light toward an object opposing the ejecting unit to detect information by receiving reflected light generated when the light is reflected. For example, JP-A-2004-284278 discloses an inkjet recorder provided with a sensor including a light emitting diode, a diffused light receiver, and a total reflected light receiver.

The detector detects information by emitting light toward an object opposing the ejecting unit and receiving reflected light generated when the light is reflected. Detection accuracy of the detector decreases when the portion that emits light or the portion that receives light is contaminated with, for example, a mist of liquid ejected from the liquid ejecting device. The inkjet recorder disclosed in JP-A-2004-284278 includes a retractable sensor cover and the sensor may become contaminated with ink mist when the cover is opened.

SUMMARY

A liquid ejecting device according to the present disclosure for solving the above-described problem includes an ejecting unit configured to eject a liquid onto a medium, a detector configured to emit light toward an object opposing the ejecting unit and receive reflected light generated by reflection of the light thereby detecting information, and a cover portion a cover that transmits the light and is disposed at a position to cover the detector, in which the cover portion is configured to move the cover so as to change a portion of the cover that covers the detector while the detector remains covered.

DESCRIPTION OF EXEMPLARY EMBODIMENTS

Figure 1:
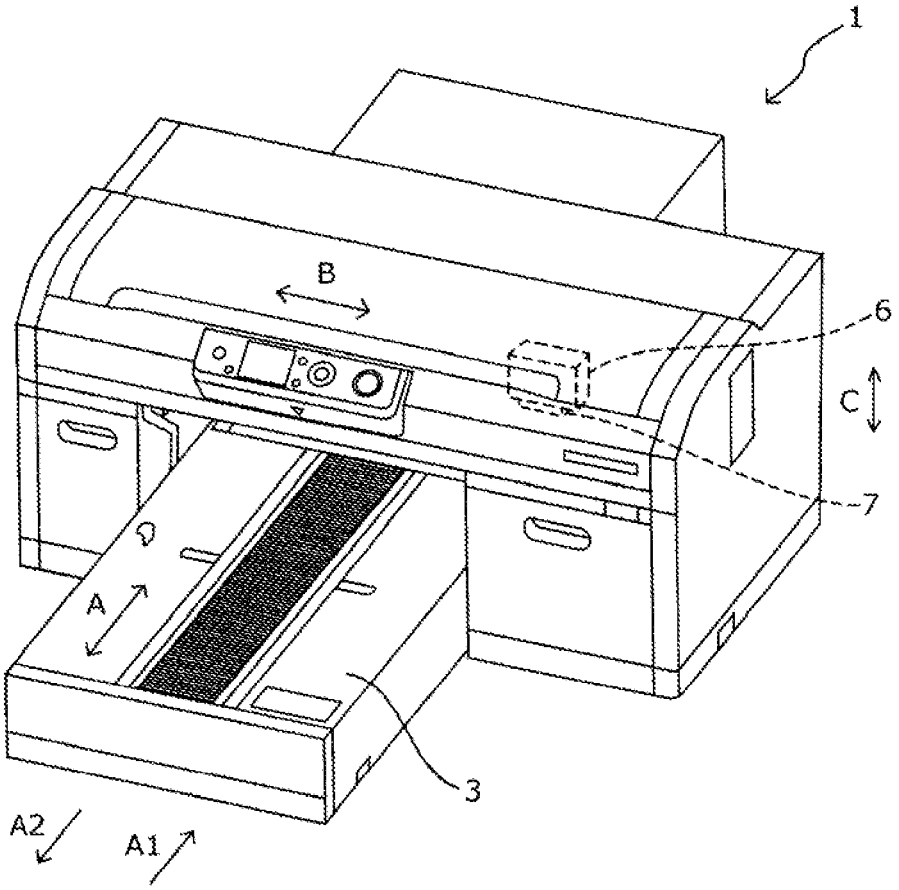
FIG. 1 is a schematic perspective view illustrating a liquid ejecting device according to Working Example 1 of the present disclosure.

First, the present disclosure will be schematically described.

A liquid ejecting device according to a first aspect of the present disclosure for solving the above-described problem includes an ejecting unit configured to eject a liquid onto a medium, a detector configured to emit light toward an object opposing the ejecting unit and receive reflected light generated by reflection of the light thereby detecting information, and a cover portion including a cover that transmits the light and is disposed at a position to cover the detector, in which the cover portion is configured to move the cover so as to change a portion of the cover that covers the detector while the detector remains covered.

According to this aspect, the cover is configured to move the cover so as to change the portion of the cover that covers the detector while the detector remains covered. Thus, the portion that covers the detector can be changed when the cover is contaminated without creating a state in which the detector is not covered by the cover. Accordingly, a decrease in detection accuracy of the detector can be suppressed.

A liquid ejecting device according to a second aspect of the present disclosure is the liquid ejecting device according to the first aspect, in which the cover portion is configured to rotate the cover to change the portion of the cover that covers the detector while the detector remains covered.

According to this aspect, the cover is rotated to change the portion that covers the detector. Thus, the portion that covers the detector can be easily changed and the cover can be easily reused by, for example, cleaning the portion that covered the detector.

A liquid ejecting device according to a third aspect of the present disclosure is the liquid ejecting device according to the second aspect, in which, when a direction in which the detector and the medium oppose each other is defined as an opposing direction, the cover portion is configured to rotate the cover about a direction along the opposing direction as a rotational axis.

According to this aspect, it is easy to form a configuration where, for example, the cover is formed into a disk shape and the cover is rotated to change the portion that covers the detector.

A liquid ejecting device according to a fourth aspect of the present disclosure is the liquid ejecting device according to the second aspect, in which, when a direction in which the detector and the medium oppose each other is defined as an opposing direction, the cover portion is configured to rotate the cover about a direction along an intersecting direction that intersects with the opposing direction as a rotational axis.

According to this aspect, by forming the cover into an endless belt shape, the portion of the cover that does not cover the detector can be efficiently moved away from the ejecting head and prevented from becoming contaminated with ink mist.

A liquid ejecting device according to a fifth aspect of the present disclosure is the liquid ejecting device according to any one of the first to fourth aspects, further including a motor that imparts a moving force for moving the cover.

According to this aspect, it is easy to form a configuration where a motor imparts moving force to move the cover.

A liquid ejecting device according to a sixth aspect of the present disclosure is the liquid ejecting device according to any one of the second to fourth aspects, further including a holding unit holding the detector, a movement mechanism causing the holding unit to reciprocate, and a protruding portion formed in a reciprocation range of the holding unit, in which the cover unit includes a toothed gear at a position that makes contact with the protruding portion when the holding unit reciprocates, the toothed gear moving together with the cover, and a tooth of the toothed gear coming into contact with the protruding portion as the holding unit reciprocates moves the toothed gear.

According to this aspect, the liquid ejecting device can have a ratchet structure made up of the toothed gear and the protruding portion, thereby forming a configuration that imparts a movement force for moving the cover without including a dedicated drive source.

A liquid ejecting device according to a seventh aspect of the present disclosure is the liquid ejecting device according to any one of the first to sixth aspects, in which the cover portion includes a sub-cover covering a portion of the cover that does not cover the detector.

According to this aspect, because the liquid ejecting device includes the sub-cover that covers a portion of the cover that does not cover the detector, the portion that does not cover the detector can be prevented from being contaminated.

A liquid ejecting device according to an eighth aspect of the present disclosure is the liquid ejecting device according to any one of the first to seventh aspects, further including a cleaning unit configured to clean the cover at a position of the portion of the cover that does not cover the detector.

According to this aspect, because the liquid ejecting device includes the cleaning unit that cleans the cover at the position of the portion of the cover that does not cover the detector, the cleaning unit can be used to clean and reuse the portion of the cover that covers the detector without the cleaning unit interfering with detection of the detector.

A liquid ejecting device according to a ninth aspect of the present disclosure is the liquid ejecting device according to any one of the first to eighth aspects, further including a control unit configured to control movement of the cover, in which the control unit moves the cover when determining that contamination of the cover has reached a predetermined degree or higher.

According to this aspect, because the cover can be moved when it is determined that contamination of the cover has reached a predetermined degree or higher, it is possible to minimize occurrence of the cover being unnecessarily moved when contamination of the cover is less than a predetermined degree and detection accuracy is not impaired.

Now, a liquid ejecting device 1 according to one working example of the present disclosure will be described in detail with reference to the appended drawings.

Working Example 1 (FIGS. 1 to 5)

Figure 2:
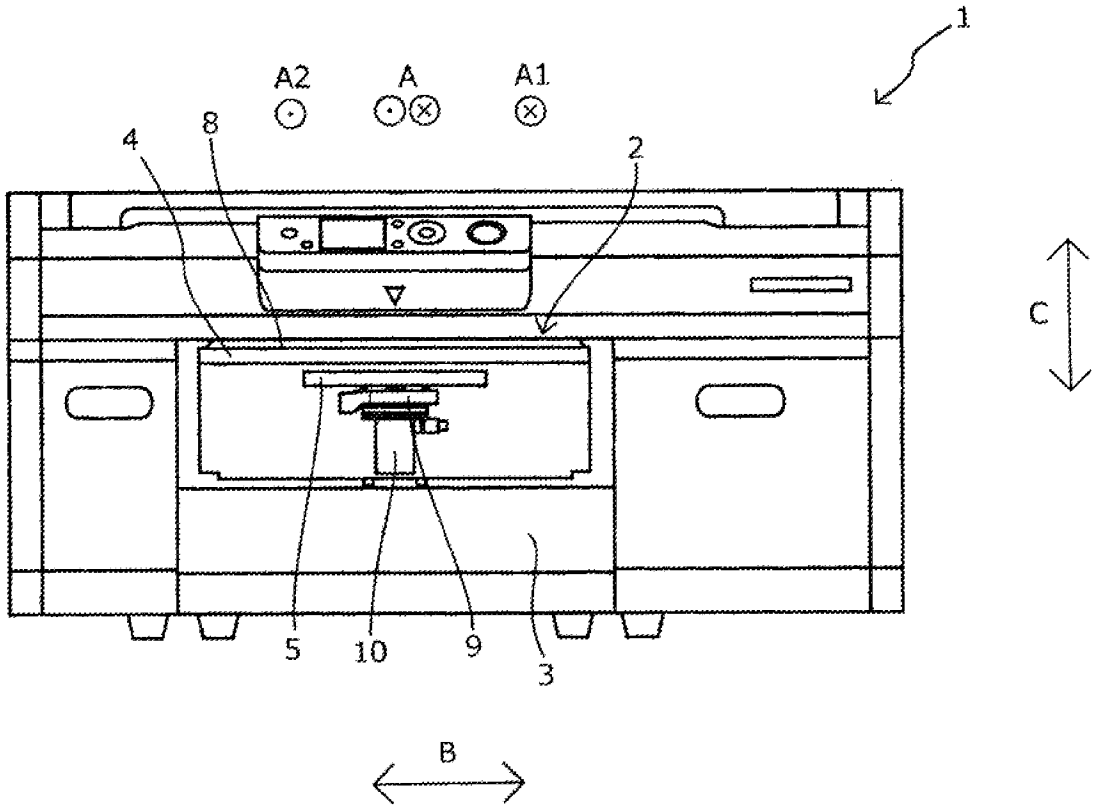
FIG. 2 is a schematic front view illustrating the liquid ejecting device according to Working Example 1 of the present disclosure.
Figure 3:
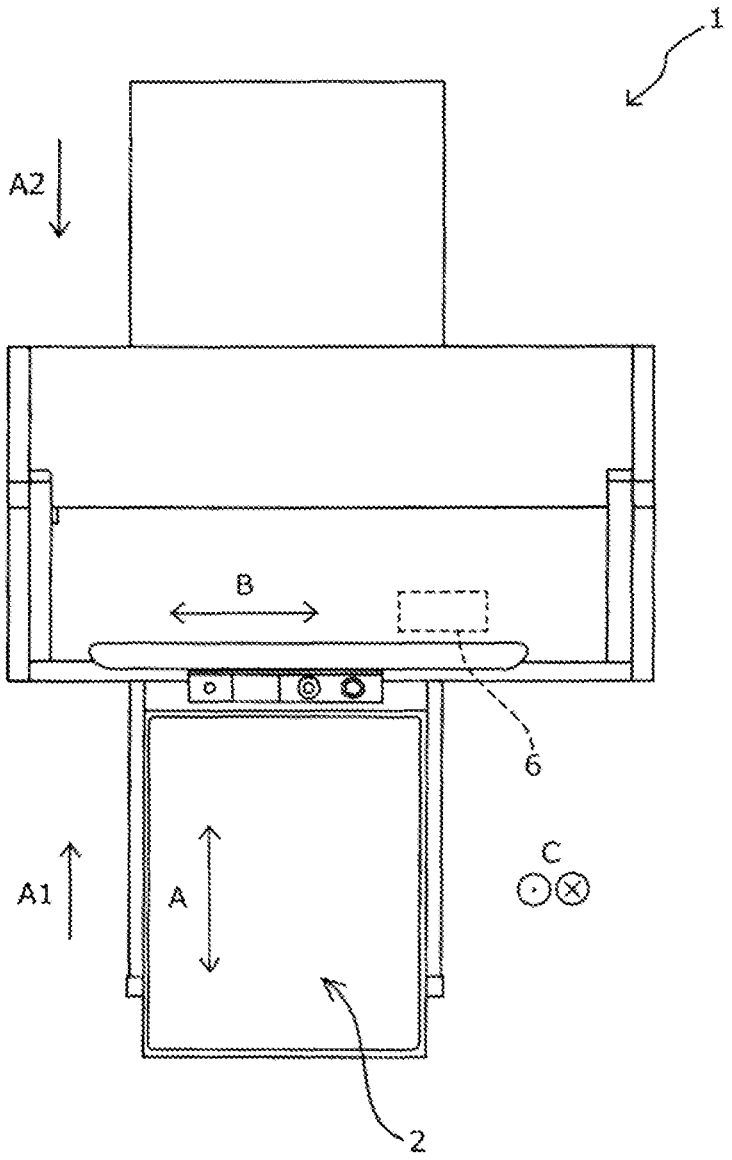
FIG. 3 is a schematic plan view illustrating the liquid ejecting device according to Working Example 1 of the present disclosure.

First, an outline of the liquid ejecting device 1 according to Working Example 1 will be described with reference to FIGS. 1 to 3. FIG. 1 is a schematic perspective view of the liquid ejecting device 1. FIG. 2 is a schematic front view of the liquid ejecting device 1. FIG. 3 is a schematic plan view of the liquid ejecting device 1. Note that FIGS. 1 to 3 illustrate a configuration in which some components have been simplified. A printing start position denotes a start position of a medium support unit 2 when printing onto a medium starts. A set position denotes a stop position of the medium support unit 2 when the medium is set on the medium support unit 2.

The liquid ejecting device 1 according to the present working example includes the medium support unit 2, which moves in a movement direction A while supporting the medium. The medium support unit 2 includes a tray 4, which is a support portion that supports the medium. The tray 4 has a support face 8 and the medium is supported on the support face 8. The liquid ejecting device 1 includes a medium transport unit 3 configured to transport the medium supported by the tray 4 in the movement direction A. The movement direction A is a direction including a direction A1 and a direction A2 opposite from the direction A1. In addition, the tray 4 is detachably mounted on a stage 5, which functions as a base unit. Here, an attachment/detachment direction C in which the tray 4 is attached to/removed from the stage 5 corresponds to the vertical direction for the liquid ejecting device 1 according to the present working example. A lever 9 is a component that adjusts the height of the tray 4, namely, the distance between the tray 4 and a liquid ejecting head 7. Rotating the lever 9 causes the tray 4 to move with the stage 5 in the vertical direction, which is a direction along the attachment/detachment direction C. Note that, as illustrated in FIG. 2, the lever 9 is provided on an arm portion 10 of the medium support unit 2. A variety of materials can be used as the medium. Examples thereof include textiles such as fabric and cloth, paper, and vinyl chloride resin.

The liquid ejecting head 7 serves as an ejecting unit configured to eject ink, which is an example of a liquid, to form an image on a medium. The liquid ejecting head 7 is provided inside the body of the liquid ejecting device 1. Forming an image on a medium with ink is also referred to as "printing an image on a medium". Note that the ink is supplied to the liquid ejecting head 7 from a plurality of ink cartridges. One ink cartridge is provided for each color. The liquid ejecting device 1 according to the present working example causes a carriage 6 provided with the liquid ejecting head 7 to reciprocate in a scanning direction B that intersects with the movement direction A. The liquid ejecting device 1 forms a desired image on the medium supported by the tray 4 by ejecting ink from the liquid ejecting head 7 onto the medium while causing the liquid ejecting head 7 to reciprocate in the scanning direction B.

Note that, in the liquid ejecting device 1 according to the present working example, a front side, which is the lower-left direction in FIG. 1, corresponds to the set position of the medium on the tray 4. The tray 4 on which the medium is set is moved in a direction A1 of the movement direction A until the tray 4 reaches the printing start position on a rear side, which is the upper-right direction in FIG. 1. Printing is then carried out while the tray 4 is moved in a direction A2 of the movement direction A.

The liquid ejecting device 1 according to the present working example includes the liquid ejecting head 7 configured to print while reciprocating in the scanning direction B. Alternatively, the liquid ejecting device 1 may include what is known as a line head, in which a plurality of nozzles that eject ink are provided in an intersecting direction which intersects with the movement direction of the medium.

Here, a "line head" is a liquid ejecting head provided such that a region including the nozzles formed in the intersecting direction which intersects with the movement direction of the medium is able to cover the entire intersecting direction, and is used in a liquid ejecting device configured to form an image by moving at least one of the print head and the medium relative to each other. Note that the area including the nozzles formed in the intersecting direction of the line head may not be configured to cover the entire intersecting direction for all types of media that can be used in the liquid ejecting device.

Figure 4:
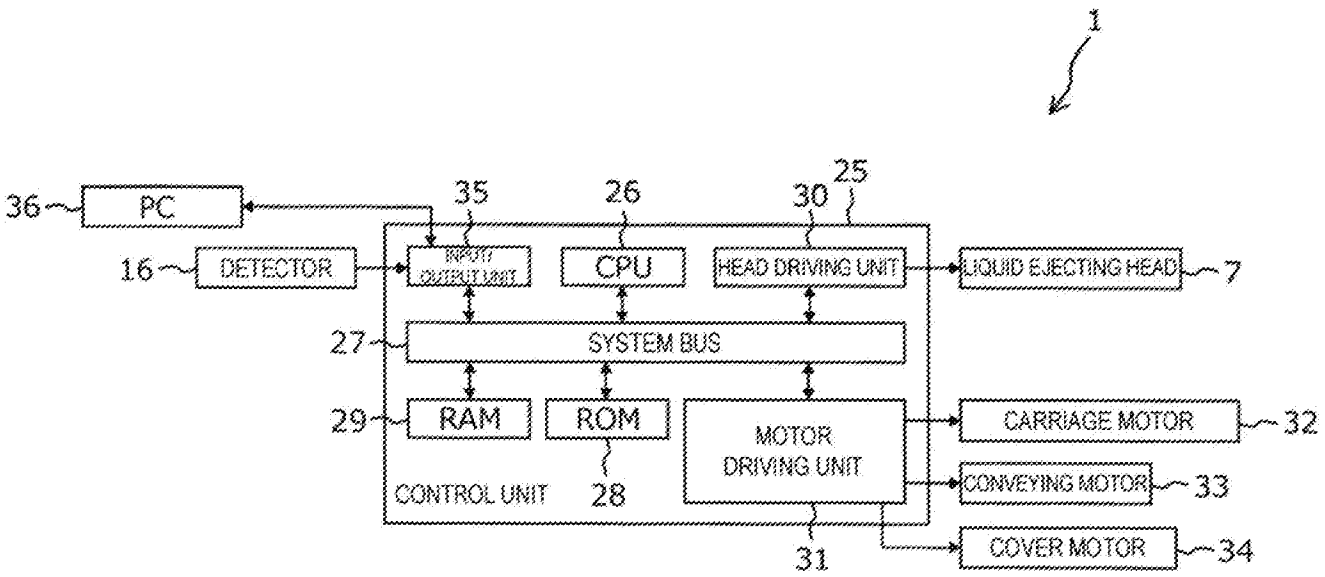
FIG. 4 is a block diagram of the liquid ejecting device according to Working Example 1 of the present disclosure.

Next, the electrical configuration of the liquid ejecting device 1 according to the present working example will be described with reference to FIG. 4. FIG. 4 is a block diagram of the liquid ejecting device 1.

A control unit 25 is provided with a CPU 26 that manages control of the entire liquid ejecting device 1. The CPU 26 is connected through a system bus 27 to a ROM 28 that stores various types of control programs executed by the CPU 26 and other data, and a RAM 29 configured to temporarily store data.

The CPU 26 is also connected through the system bus 27 to a head driving unit 30 configured to drive the liquid ejecting head 7.

The CPU 26 is further connected to a motor driving unit 31 through the system bus 27. The motor driving unit 31 is connected to a carriage motor 32 configured to move the carriage 6 provided with the liquid ejecting head 7 in the scanning direction B, a transport motor 33 configured to transport the medium, that is, move the tray 4 in the movement direction A, and a cover motor 34 configured to move a cover 11, which will be described later.

Further, the CPU 26 is connected to an input-output unit 35 through the system bus 27. The input-output unit 35 is connected to a detector 16 and a PC 36, which will be described later.

Figure 5:
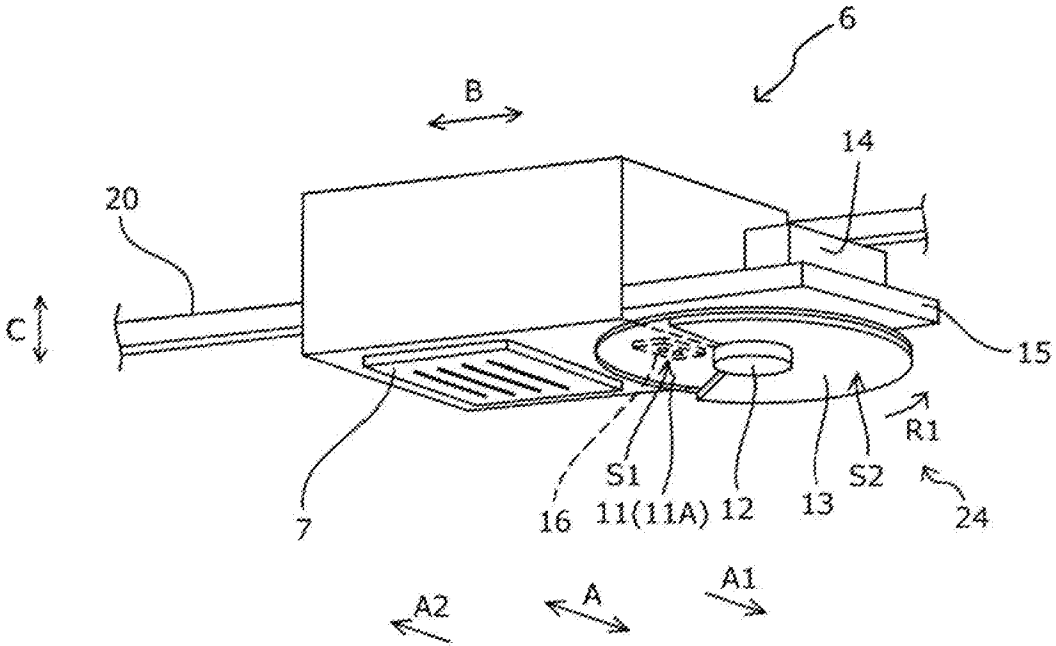
FIG. 5 is a schematic perspective view illustrating a carriage of the liquid ejecting device according to Working Example 1 of the present disclosure.

Next, the carriage 6, which is an important part of the liquid ejecting device 1 according to the present working example, will be described with reference to FIG. 5. FIG. 5 is a schematic perspective view of the carriage 6.

The carriage 6 according to the present working example is configured to move in the scanning direction B along a guide shaft 20 that extends in the scanning direction B. As illustrated in FIG. 5, the carriage 6 according to the present working example includes the detector 16 in addition to the liquid ejecting head 7 configured to eject ink onto a medium. The detector 16 is configured to detect the presence of a medium and an end portion of the medium. In other words, the carriage 6 functions as a holding unit that holds the liquid ejecting head 7 and the detector 16. Note that the liquid ejecting head 7 and the detector 16 may each be held by a separate carriage.

The detector 16 according to the present working example is configured to emit light toward an object opposing the liquid ejecting head 7 and receive reflected light generated by reflection of the light. More specifically, the detector 16 includes a light-emitting unit configured to emit light toward an object opposing the liquid ejecting head 7, and a light-receiving unit configured to receive reflected light generated when the light emitted by the light-emitting unit is reflected. An "object opposing the liquid ejecting head 7" specifically refers to the medium or the support face 8, but may be another object. The light emitted by the light-emitting unit is reflected by the medium or the support face 8. The light that is reflected, that is, reflected light, is incident on the light-receiving unit. The detector 16 is configured to detect the presence of a medium and the position of an end portion of a medium based on the intensity of received light when light is received by the light-receiving unit. The light emission direction and the light receiving direction for the detector 16 are generally directions along the attachment/detachment direction C. Note that the detector 16 according to the present working example is a detector configured to detect the presence of a medium and an end portion of a medium, but the detector 16 is not limited to this configuration. Various detectors can be used, such as a detector capable of reading an image, or a detector configured to detect a convex portion on a medium, such as a pocket when a T-shirt with a pocket is used as the medium. In other words, the detector may have any configuration provided that the detector detects information related to printing.

When ink is ejected from the liquid ejecting head 7, ink that does not land on the medium may become mist and float in the liquid ejecting device 1. This ink mist may float and make contact with the detector 16, thereby adhering to the detector 16. When this happens, the detection accuracy of the detector 16 may decrease. Thus, as illustrated in FIG. 5, the carriage 6 according to the present working example is provided with a cover portion 24 including a transparent cover 11 that covers the detector 16 in order to suppress adhesion of an adhesive such as ink mist to the detector 16. Note that, in the present specification, "covers the detector 16" refers to covering the entire detector 16 from all directions as well as covering only a portion of the detector 16.

A cover 11A according to the present working example is formed in a cover forming portion 15. The cover 11A is a transparent disk-shaped member. In other words, the cover 11A is a transparent member that transmits light. The cover 11A rotates in a rotation direction R1 about a rotary shaft 12 powered by driving force from a drive unit 14. The drive unit 14 includes the cover motor 34 and other components. The cover 11 is divided into a portion S1 that covers the detector 16 and a portion S2 that does not cover the detector 16. A sub-cover 13 that covers the cover 11A so that the cover 11A is not contaminated with ink mist or the like is provided in the portion S2 of the cover 11 that does not cover the detector 16. The sub-cover 13 is not provided in the portion S1 of the cover 11 that covers the detector 16. This is because the portion S1 that covers the detector 16 is a portion opposing the detector 16 and needs to appropriately transmit light when the detector 16 emits and receives light. Note that the sub-cover 13 may be transparent or opaque.

With this configuration, the cover 11A can be disposed such that, when the control unit 25 determines that the portion S1 of the cover 11A that covers the detector 16 is contaminated, the carriage 6 according to the present working example rotates the cover 11A by a predetermined angle so that a region not contaminated due to being covered by the sub-cover 13 reaches the portion S1 that covers the detector 16. Therefore, with the carriage 6 according to the present working example, a reduction in detection accuracy when detecting the presence of a medium and an end portion of a medium due to the cover 11A being contaminated is suppressed. Because the cover 11A is disk-shaped and the position of the cover 11A can be changed by rotating the cover 11A in the rotation direction R1 about the rotary shaft 12, it can be said that the portion S1 of the cover 11A that covers the detector 16 changes while the detector 16 remains covered. Note that the cover 11 may be configured to move such that the portion S1 of the cover 11 that covers the detector 16 changes while the detector 16 remains covered, and the manner of movement may be something other than rotation. For example, the cover 11 may be configured such that linearly moving the cover 11 changes the portion S1 of the cover 11 that covers the detector 16.

To summarize, the liquid ejecting device 1 according to the present working example includes the liquid ejecting head 7 that ejects ink onto a medium, the detector 16 that emits light toward an object opposing the liquid ejecting head 7 and detects information by receiving reflected light generated when the light is reflected, and the cover portion 24 a cover that transmits the light and is disposed at a position to cover the detector 16. The cover portion 24 is configured to move the cover 11 so as to change the portion S1 of the cover 11 that covers the detector 16 while the detector 16 remains covered.

Because the cover portion 24 according to the present working example is configured such that the cover 11 can move to change the portion S1 of the cover 11 that covers the detector 16 while the detector 16 remains covered, when the cover 11 is contaminated, the portion S1 that covers the detector 16 can be changed without creating a state where the detector 16 is not covered by the cover 11. Accordingly, the liquid ejecting device 1 according to the present working example is configured to suppress a reduction in detection accuracy of the detector 16. Note that, for example, a detector that detects the presence of a medium or an end portion of a medium in the width direction, such as the detector 16 according to the present working example, a detector that forms a test pattern on a medium and detects the test pattern, and a detector that detects various markings formed on a medium or the liquid ejecting device 1 may be used as the detector 16.

As described above, in the liquid ejecting device 1 according to the present working example, the cover portion 24 is configured such that the cover 11 is rotated to change the portion S1 of the cover 11 that covers the detector 16 while the detector 16 remains covered. Thus, in the liquid ejecting device 1 according to the present working example, because the cover 11 is rotated to change the portion S1 that covers the detector 16, the portion S1 that covers the detector 16 can be easily changed and the cover 11 can be easily reused by, for example, cleaning a portion covering the detector 16 that becomes contaminated when removing the detector 16.

As described above, in the liquid ejecting device 1 according to the present working example, the cover portion 24 is configured such that the cover 11 can rotate in the rotation direction R1 with a direction along the attachment/detachment direction C as the rotary shaft 12. At this time, the attachment/detachment direction C can be described as an opposing direction in which the detector 16 and the medium oppose each other. In other words, when a direction in which the detector 16 and the medium oppose each other is the opposing direction, the cover portion 24 according to the present working example is configured such that the cover 11 can rotate with a direction along the opposing direction as the rotary shaft 12. As a result, it is possible to particularly easily form a configuration in which the cover 11 is formed into a disk shape or similar shape such as the cover 11A according to the present working example, and the cover 11 is rotated to change the portion S1 that covers the detector 16.

As described above, the liquid ejecting device 1 according to the present working example includes the cover motor 34, which is a motor that imparts a rotational force for rotating the cover 11. Therefore, the liquid ejecting device 1 according to the present working example is easily configured such that the cover motor 34 imparts movement force for moving the cover 11.

As described above, in the liquid ejecting device 1 according to the present working example, the cover portion 24 includes a sub-cover 13 that covers the portion S2 of the cover 11 that does not cover the detector 16. Therefore, the liquid ejecting device 1 according to the present working example is configured to suppress contamination of the portion S2 that does not cover the detector 16. Note that, in the cover 11, the portion S2 that does not cover the detector 16 is at least part of a region not including the portion S1 that covers the detector 16.

As described above, the liquid ejecting device 1 according to the present working example includes the control unit 25 configured to control the movement of the cover 11. The control unit 25 can move the cover 11 when it is determined that the cover 11 is contaminated to a predetermined degree or higher. Therefore, the liquid ejecting device 1 according to the present working example is configured to minimize occurrence of the cover 11 being unnecessarily moved when contamination of the cover 11 is less than a predetermined degree and detection accuracy is not impaired. Note that the criteria for determining whether the cover 11 is contaminated to a predetermined degree or higher may include, for example, the following judgment criteria. Specific examples include the presence or absence of a decrease in the light receiving intensity of the detector 16 when the detector 16 has emitted light toward a predetermined target object, the total amount of ink ejected from the liquid ejecting head 7, the number of hours the liquid ejecting device 1 has been driven or the number of times a liquid ejecting operation has been executed, and image analysis through directly imaging dirt on the cover 11 using a camera or the like.

The liquid ejecting device 1 according to the present working example is also capable of measuring the transmittance of the cover 11 in advance and adjusting the amount of light emitted and received by the detector 16 according to the measured transmittance. Note that the transmittance of the cover 11 may be measured using the liquid ejecting device 1, or a configuration may be adopted in which results of transmittance measured using another device are input via the PC 36 or the like.

Figure 6:
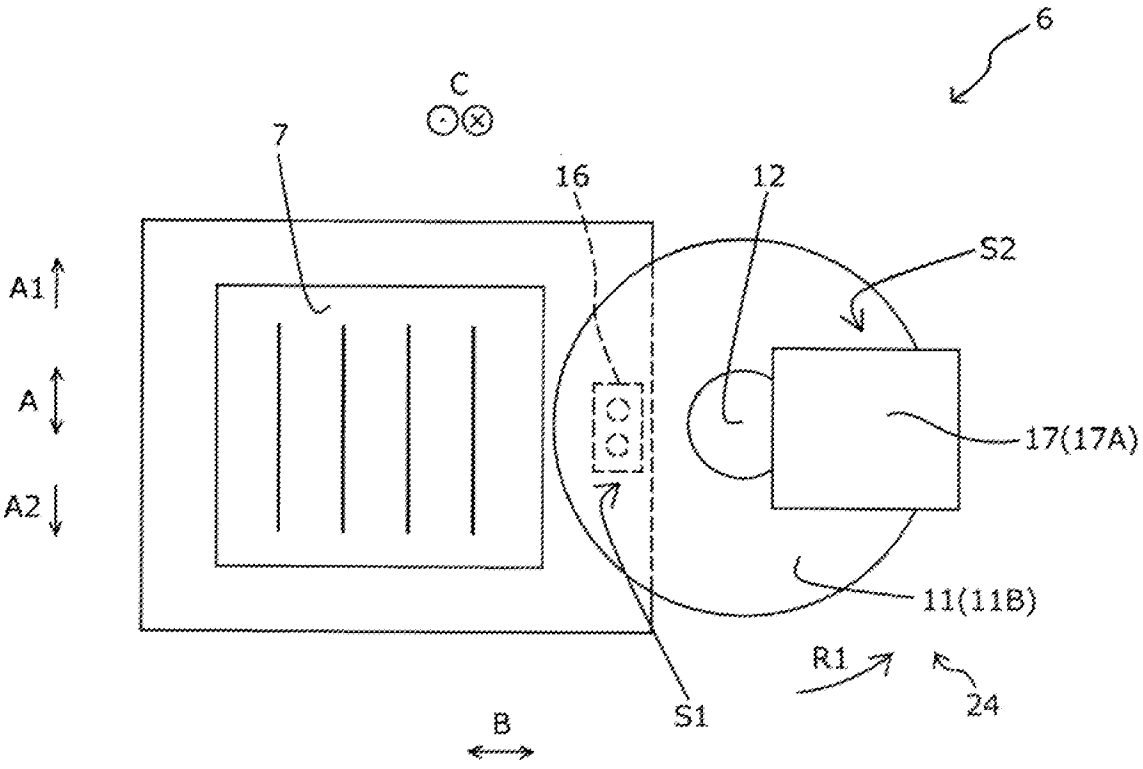
FIG. 6 is a schematic bottom view illustrating a carriage of a liquid ejecting device according to Working Example 2 of the present disclosure.

Working Example 2 (FIG. 6)

Next, the liquid ejecting device 1 of Working Example 2 will be described in detail with reference to FIG. 6. FIG. 6 is a schematic bottom view of the carriage 6. Note that, in FIG. 6, the cover forming portion 15 is omitted. Herein, component elements common to those in Working Example 1 described above are denoted by identical reference signs, and detailed descriptions of those component elements are omitted. Note that, aside from the configuration of the carriage 6, the liquid ejecting device 1 of Working Example 2 has the same configuration as the liquid ejecting device 1 of Working Example 1.

As illustrated in FIG. 6, the liquid ejecting device 1 of Working Example 2 does not include the sub-cover 13 provided in the carriage 6 of the liquid ejecting device 1 of Working Example 1, and instead includes a cleaning unit 17 that cleans the cover 11 at the portion S2 that does not cover the detector 16. In other words, the liquid ejecting device 1 according to the present working example includes a cleaning unit 17A that cleans a transparent cover 11B according to the present working example in the portion S2 of the cover 11B that does not cover the detector 16. As described above, the liquid ejecting device 1 according to the present working example includes the cleaning unit 17 that cleans the cover 11 at the position of the portion S2 of the cover 11 that does not cover the detector 16. Thus, the cleaning unit 17 can be used to clean and reuse the portion of the cover 11 that covers the detector 16 without the cleaning unit 17 interfering with detection of the detector 16.

Note that, although the liquid ejecting device 1 according to the present working example does not include the sub-cover 13, a configuration may be adopted where the cleaning unit 17 and the sub-cover 13 are provided together. The cleaning unit 17 is not particular limited and may be a fabric, a rubber, or a similar material. The cleaning unit 17 may be configured to allow introduction of a cleaning liquid such as a solvent, or a member immersed with cleaning liquid may be used. Further, the shape of the cleaning unit 17 is not particularly limited and may be, for example, a shape that sandwiches the cover 11 from a direction along the attachment/detachment direction C, or a shape in which a member is pressed against the cover 11 from a side opposing the medium.

Figure 7:
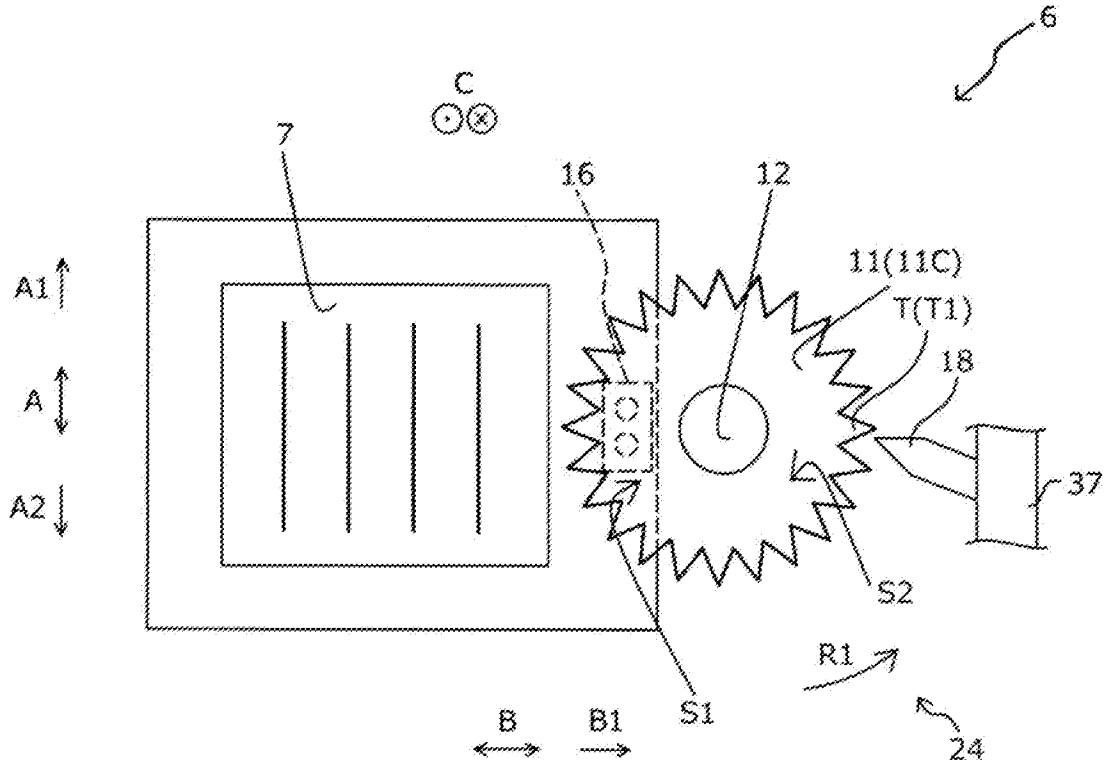
FIG. 7 is a schematic bottom view illustrating a carriage of a liquid ejecting device according to Working Example 3 of the present disclosure, where a toothed gear and a protruding portion are not in contact.
Figure 8:
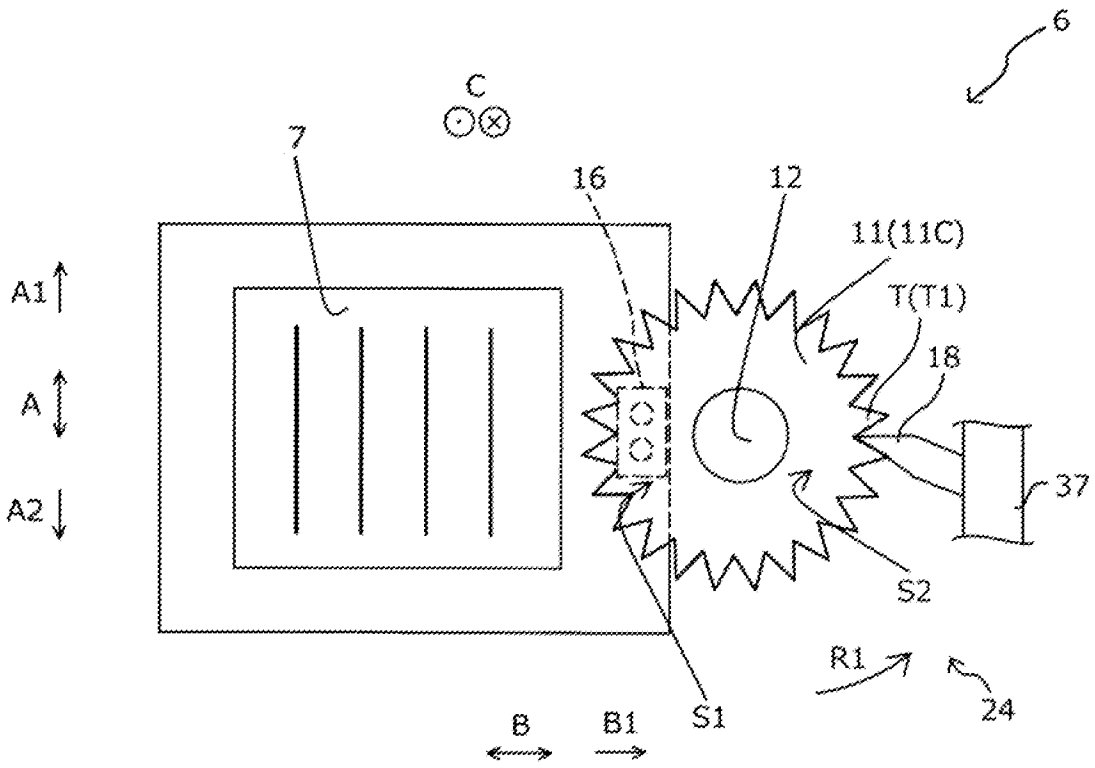
FIG. 8 is a schematic bottom view illustrating the carriage of the liquid ejecting device according to Working Example 3 of the present disclosure, where the toothed gear and the protruding portion are in contact.

Working Example 3 (FIGS. 7 and 8)

Now, the liquid ejecting device 1 according to Working Example 3 will be described in detail with reference to FIGS. 7 and 8. FIGS. 7 and 8 are schematic bottom views of the carriage 6. Note that the cover forming portion 15 is omitted in FIGS. 7 and 8. Herein, component elements common to those in Working Examples 1 and 2 described above are denoted by identical reference signs, and detailed descriptions of those component elements are omitted. Note that, aside from the configuration of the carriage 6, the liquid ejecting device 1 of Working Example 3 has the same configuration as the liquid ejecting device 1 of Working Examples 1 and 2.

As illustrated in FIGS. 7 and 8, the liquid ejecting device 1 of Working Example 3 includes a toothed gear-shaped cover 11C as the transparent cover 11 in place of the disk-shaped covers 11A and 11B provided in the carriage 6 of the liquid ejecting device 1 of Working Examples 1 and 2. In addition, the liquid ejecting device 1 includes a frame portion 37 provided with a protruding portion 18 that can make contact with teeth T of the toothed gear-shaped cover 11C. In the liquid ejecting device 1 according to the present working example, the protruding portion 18 is formed at a position that does not make contact with the cover 11C during normal movement of the carriage 6 in the scanning direction B within an image formation range of the carriage 6. In the liquid ejecting device 1 according to the present working example, when the control unit 25 determines that the cover 11C is contaminated to a predetermined degree or higher, the carriage 6 is moved in the scanning direction B beyond the normal image formation range of the carriage 6 to cause the cover 11C to make contact with the protruding portion 18. FIG. 7 illustrates a state where the carriage 6 moves in a direction B1 of the scanning direction B and a tooth T1 of the teeth T is in a state immediately prior to making contact with the protruding portion 18. FIG. 8 illustrates a state where the carriage 6 moves to an end portion further in the direction B1 within the scanning range of the carriage 6 and the tooth T1 is in contact with the protruding portion 18 and, as a result, the cover 11C has rotated by a predetermined amount in the rotation direction R1.

In other words, the liquid ejecting device 1 according to the present working example includes the carriage 6 as a holding unit that holds the detector 16, the carriage motor 32 as a movement mechanism for causing the carriage 6 to reciprocate in the scanning direction B, and the protruding portion 18 formed in a reciprocation range of the carriage 6. The cover portion 24 includes a toothed gear, which is the cover 11C, at a position where the cover 11C can make contact with the protruding portion 18 as the carriage 6 reciprocates. The cover 11C moves in the rotation direction R1 when the teeth T of the cover 11C come into contact with the protruding portions 18 due to the reciprocating movement of the carriage 6. Thus, the liquid ejecting device 1 according to the present working example has a ratchet structure made up of the toothed gear and the protruding portion 18, thereby forming a configuration that imparts a movement force for moving the cover 11 without including a dedicated drive source. Note that, in the liquid ejecting device 1 according to the present working example, the cover 11C also serves as a toothed gear, but the toothed gear and the cover 11 may be configured as separate members. The protruding portion 18 according to the present working example is fixed to the frame portion 37 in an immovable state, but the protruding portion 18 may be housed in the frame portion 37 and caused to protrude outward within the range of movement of the carriage 6 when the protrusion 18 is to be brought into contact with the cover 11C.

Figure 9:
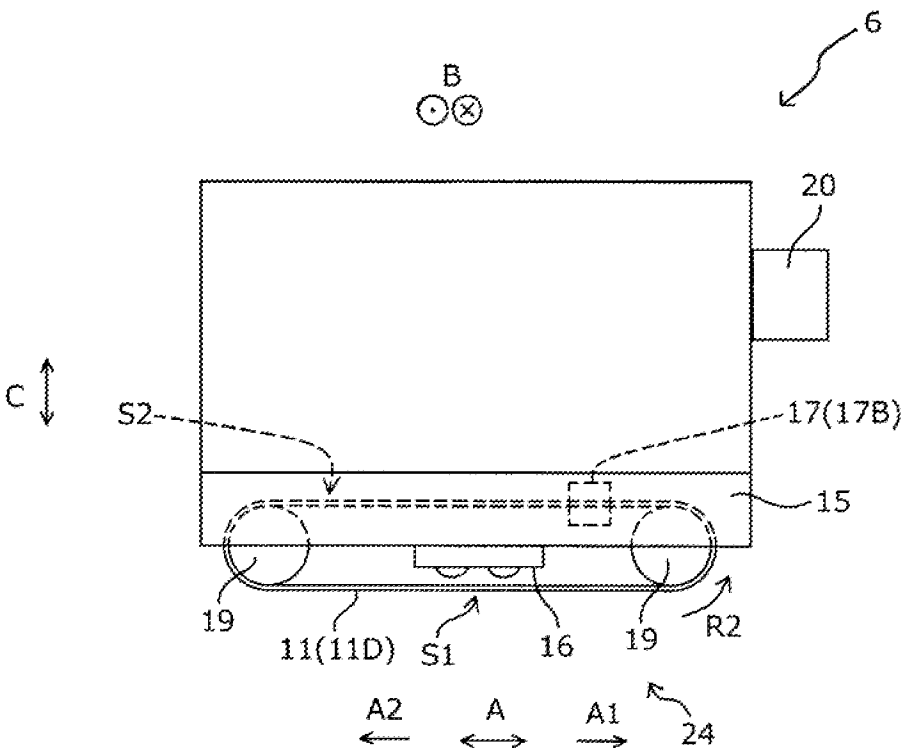
FIG. 9 is a schematic side view illustrating a carriage of a liquid ejecting device according to Working Example 4 of the present disclosure.

Working Example 4 (FIG. 9)

Now, the liquid ejecting device 1 according to Working Example 4 will be described in detail with reference to FIG. 9. FIG. 9 is a schematic side view of the carriage 6. Herein, component elements common to those in Working Examples 1 to 3 described above are denoted by identical reference signs, and detailed descriptions of those component elements are omitted. Note that, aside from the configuration of the carriage 6, the liquid ejecting device 1 of Working Example 4 has the same configuration as the liquid ejecting device 1 of Working Examples 1 to 3.

As illustrated in FIG. 9, the liquid ejecting device 1 of Working Example 4 includes a cover 11D having an endless belt shape as the transparent cover 11 in place of the disk-shaped cover 11 provided in the carriage 6 of the liquid ejecting device 1 of Working Examples 1 to 3. In this working example, the cover portion 24 includes two rollers 19 that rotate the endless belt-shaped cover 11D in a rotation direction R2, and a cleaning unit 17B that cleans the cover 11D.

Figure 10:
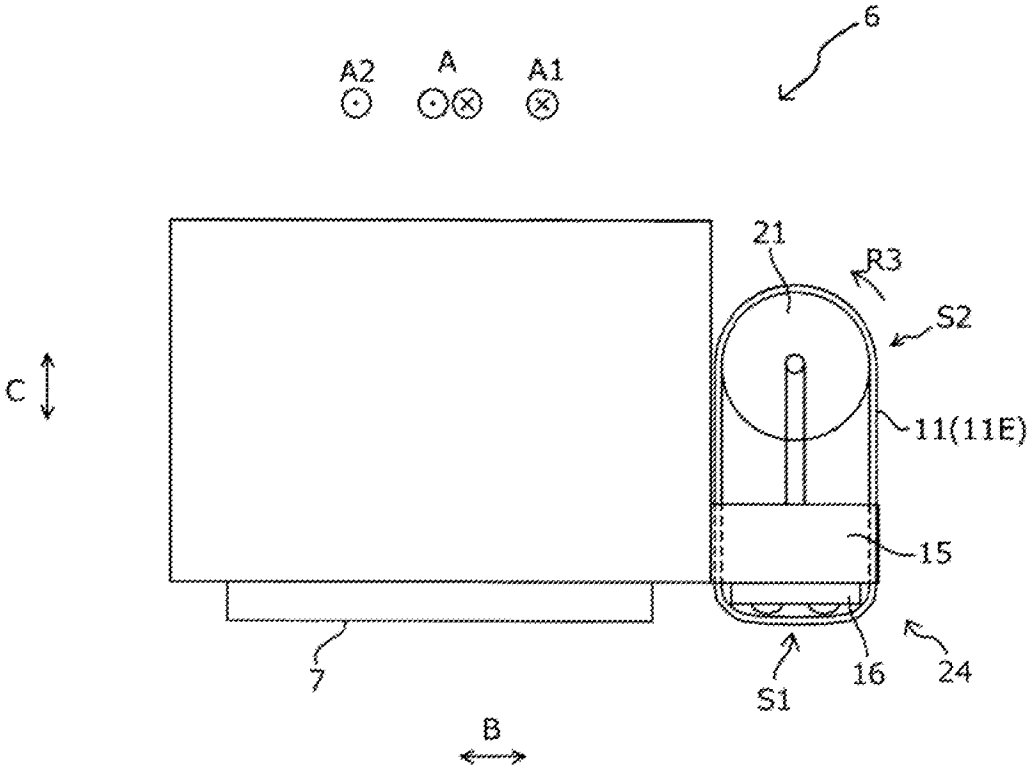
FIG. 10 is a schematic front view illustrating a carriage of a liquid ejecting device according to Working Example 5 of the present disclosure.

Working Example 5 (FIG. 10)

Now, a liquid ejecting device 1 according to Working Example 5 will be described in detail with reference to FIG.

10. FIG. 10 is a schematic front view illustrating the carriage 6. Herein, component elements common to those in Working Examples 1 to 4 described above are denoted by identical reference signs, and detailed descriptions of those component elements are omitted. Note that, aside from the configuration of the carriage 6, the liquid ejecting device 1 of Working Example 5 has the same configuration as the liquid ejecting device 1 of Working Examples 1 to 4.

As illustrated in FIG. 10, similar to the liquid ejecting device 1 of Working Example 4, the liquid ejecting device 1 of Working Example 5 includes a cover 11E having an endless belt shape as the transparent cover 11 in place of the disk-shaped cover 11 provided in the carriage 6 of the liquid ejecting device 1 of Working Examples 1 to 3. In this working example, the cover portion 24 includes a roller 21 that rotates the endless belt-shaped cover 11E in a rotation direction R3.

Figure 11:
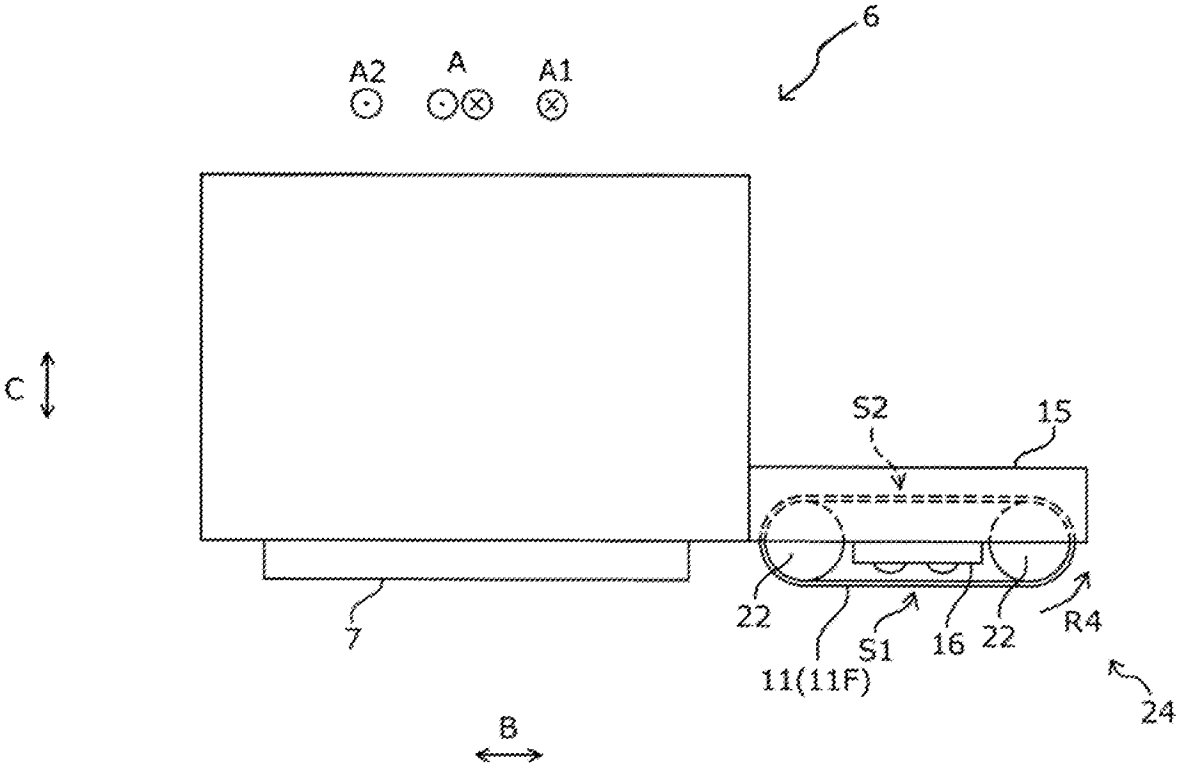
FIG. 11 is a schematic front view illustrating a carriage of a liquid ejecting device according to Working Example 6 of the present disclosure.

Working Example 6 (FIG. 11)

Now, the liquid ejecting device 1 according to Working Example 6 will be described in detail with reference to FIG. 11. FIG. 11 is a schematic front view illustrating the carriage 6. Herein, component elements common to those in Working Examples 1 to 5 described above are denoted by identical reference signs, and detailed descriptions of those component elements are omitted. Note that, aside from the configuration of the carriage 6, the liquid ejecting device 1 of Working Example 6 has the same configuration as the liquid ejecting device 1 of Working Examples 1 to 5.

As illustrated in FIG. 11, similar to the liquid ejecting device 1 of Working Examples 4 and 5, the liquid ejecting device 1 of Working Example 6 includes a cover 11F having an endless belt shape as the transparent cover 11 in place of the disk-shaped cover 11 provided in the carriage 6 of the liquid ejecting device 1 of Working Examples 1 to 3. In this working example, the cover portion 24 includes two rollers 22 that rotate the endless belt-shaped cover 11F in a rotation direction R4.

As described above, in the liquid ejecting device 1 of Working Examples 4 to 6, the cover portion 24 is configured to allow the cover 11 to rotate with a direction along an intersecting direction that intersects with the attachment/detachment direction C as the rotary shaft. Here, the "intersecting direction" corresponds to the scanning direction B in Working Example 4 and the movement direction A in Working Examples 5 and 6. At this time, the attachment/detachment direction C can be said to be the opposing direction in which the detector 16 and the medium oppose each other. In other words, when the direction in which the detector 16 and the medium oppose each other is the opposing direction, the cover portion 24 according to the present working example is configured to allow the cover 11 to rotate with a direction along an intersecting direction that intersects with the opposing direction as the rotary shaft. Further, in the liquid ejecting device 1 of Working Examples 4 to 6, the cover 11 is formed as an endless belt. As a result, the portion S2 of the cover 11 that does not cover the detector 16 can be efficiently moved away from the liquid discharging head 7 and is prevented from becoming contaminated with ink mist. Among the liquid ejecting devices 1 of Working Examples 4 to 6, only the liquid ejecting device 1 of Working Example 4 is provided with the cleaning unit 17. However, the liquid ejecting device 1 of Working Examples 5 and 6 may be provided with the cleaning unit 17, or the cleaning unit 17 may be omitted from the liquid ejecting device 1 of Working Example 4.

Figure 12:
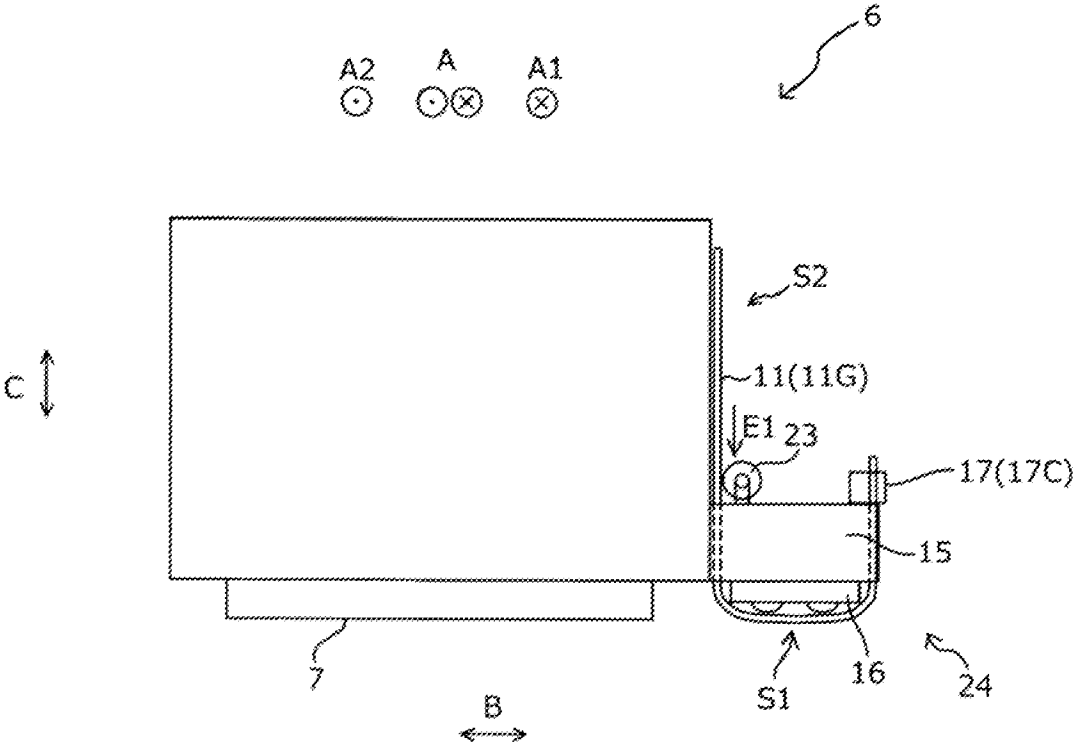
FIG. 12 is a schematic front view illustrating a carriage of a liquid ejecting device according to Working Example 7 of the present disclosure.

Working Example 7 (FIG. 12)

Now, the liquid ejecting device 1 of Working Example 7 will be described in detail with reference to FIG. 12. FIG. 12 is a schematic front view illustrating the carriage 6. Herein, component elements common to those in Working Examples 1 to 6 described above are denoted by identical reference signs, and detailed descriptions of those component elements are omitted. Note that, aside from the configuration of the carriage 6, the liquid ejecting device 1 of Working Example 7 has the same configuration as the liquid ejecting device 1 of Working Examples 1 to 6.

As illustrated in FIG. 12, the liquid ejecting device 1 of Working Example 7 includes a linear cover 11G as the transparent cover 11. In this working example, the cover portion 24 includes a roller 23 that moves the linear cover 11G in a movement direction E1, and a cleaning unit 17C that cleans the cover 11G. Note that, because the liquid ejecting device 1 according to the present working example includes the cleaning unit 17C, a cover 11G that has been used can be reset and used repeatedly. However, the liquid ejecting device 1 is not limited to this configuration and may not include a cleaning unit 17. In addition, the sub-cover 13 may be formed on not only the disk-shaped cover 11 provided in the liquid ejecting device 1 of Working Example 1 but also the endless belt-shaped cover 11 provided in the liquid ejecting device 1 of Working Examples 4 to 6 and the linear cover 11 provided in the liquid ejecting device 1 of the present working example. In this case, the sub-cover 13 may be provided so as to at least partially cover a portion of the cover 11 that does not oppose the detector 16 and that is exposed to the outside.

Note that the disclosure is not limited to the aforementioned example, and many variations are possible within the scope of the disclosure as described in the appended claims. It goes without saying that such variations also fall within the scope of the disclosure. For example, the liquid ejecting device 1 according to the above-described working examples has a configuration in which the medium is supported by the tray 4 and transported by moving the tray 4. However, the liquid ejecting device 1 may be a liquid ejecting device having a configuration different to that in the working examples described above. For example, the liquid ejecting device 1 may be configured to transport the medium using transport rollers, a transport belt or a transport drum, or move the ejecting unit relative to a stopped medium to form an image.

What is claimed is:

1. A liquid ejecting device comprising:

an ejecting unit configured to eject a liquid onto a medium;

a detector configured to emit light toward an object opposing the ejecting unit and receive reflected light generated by reflection of the light thereby detecting information; and a cover portion including a cover that transmits the light and is disposed at a position to cover the detector, wherein the cover portion is configured to move the cover so as to change a portion of the cover that covers the detector while the detector remains covered, and wherein the cover portion is configured to rotate the cover to change the portion of the cover that covers the detector while the detector remains covered.

2. The liquid ejecting device according to claim 1, wherein, when a direction in which the detector and the medium oppose each other is defined as an opposing direction, the cover portion is configured to rotate the cover about a direction along the opposing direction as a rotational axis.

3. The liquid ejecting device according to claim 1, wherein, when a direction in which the detector and the medium oppose each other is defined as an opposing direction, the cover portion is configured to rotate the cover about a direction along an intersecting direction that intersects with the opposing direction as a rotational axis.

4. The liquid ejecting device according to claim 1, comprising a motor that imparts a moving force for moving the cover.

5. The liquid ejecting device according to claim 1, wherein the cover portion includes a sub-cover covering a portion of the cover that does not cover the detector.

6. The liquid ejecting device according to claim 1, comprising a cleaning unit configured to clean the cover at a position of the portion of the cover that does not cover the detector.

7. The liquid ejecting device according to claim 1, comprising:

a control unit configured to control movement of the cover, wherein the control unit moves the cover when determining that the cover is contaminated to a predetermined degree or higher.

8. A liquid ejecting device comprising:

an ejecting unit configured to eject a liquid onto a medium;

a detector configured to emit light toward an object opposing the ejecting unit and receive reflected light generated by reflection of the light thereby detecting information;

a cover portion including a cover that transmits the light and is disposed at a position to cover the detector;

a holding unit configured to hold the detector;

a movement mechanism configured to cause the holding unit to reciprocate; and a protruding portion formed in a range in which the holding unit is configured to reciprocate, wherein the cover portion is configured to move the cover so as to change a portion of the cover that covers the detector while the detector remains covered, the cover unit includes a toothed gear at a position that allows for contact with the protruding portion when the holding unit reciprocates, the toothed gear moving together with the cover, and the toothed gear is configured so that a tooth of the toothed gear coming into contact with the protruding portion, as the holding unit reciprocates, moves the toothed gear.

* * * * *